United States Patent [19]

Güntert et al.

[11] Patent Number: 4,850,823

[45] Date of Patent: Jul. 25, 1989

[54] FUEL INJECTION PUMP FOR INTERNAL COMBUSTION ENGINES

[75] Inventors: Josef Güntert, Gerlingen; Walter Häfele, Fellbach; Manfred Krämer, Schwieberdingen, all of Fed. Rep. of Germany

[73] Assignee: Robert Bosch GmbH, Stuttgart, Fed. Rep. of Germany

[21] Appl. No.: 135,157

[22] PCT Filed: Mar. 19, 1987

[86] PCT No.: PCT/DE87/00114

§ 371 Date: Nov. 18, 1987

§ 102(e) Date: Nov. 18, 1987

[87] PCT Pub. No.: WO87/05969

PCT Pub. Date: Oct. 8, 1987

[30] Foreign Application Priority Data

Mar. 24, 1986 [DE] Fed. Rep. of Germany ..... 3610927
Mar. 10, 1987 [DE] Fed. Rep. of Germany ..... 3707646

[51] Int. Cl.[4] ..... F02M 59/24; F02M 59/44
[52] U.S. Cl. ..... 417/499
[58] Field of Search ..... 417/499, 494; 123/503, 123/501, 500

[56] References Cited

U.S. PATENT DOCUMENTS 2,564,830 8/1951 Bremser ..... 417/494
2,905,020 9/1959 Ziesche ..... 417/494
3,385,221 5/1968 Parks ..... 417/494
4,661,051 4/1987 Nakamura ..... 417/499
4,706,626 11/1987 Hafele et al. ..... 123/503

FOREIGN PATENT DOCUMENTS 206783 7/1955 Australia ..... 417/494
0181402 5/1986 European Pat. Off. .
3522414 2/1986 Fed. Rep. of Germany .

*Primary Examiner*—Leonard E. Smith
*Attorney, Agent, or Firm*—Michael J. Striker

[57] ABSTRACT

Fuel injection pump for internal combustion engines comprising at least one pump element consisting of a cylinder liner (2) and a pump plunger (3), and comprising a control slide (9) on the pump plunger (3) which is rotatable for the fuel control. The control slide (9) is axially displaceable for the purpose of changing the start of injection, wherein the axial displacement is effected by means of a rotating shaft (12) which is supported in the pump housing (1), at least one adjusting bolt (14) being fastenable at the rotating shaft (12) in its installation position by means of a fastening part (clamping nut 15) after adjustment. An eccentric stud (37) of the eccentric bolt (14) is constructed so as to be cylindrical, and a slide shoe (44), which has a rectangular shape with curved contact surfaces (51), is insertable on the stud (37) by means of a central borehole (40) in order, accordingly, to ensure a line contact between the slide shoe (44) and the groove (13), and is secured against falling out by means of a pin (45).

9 Claims, 4 Drawing Sheets

FIG. 4
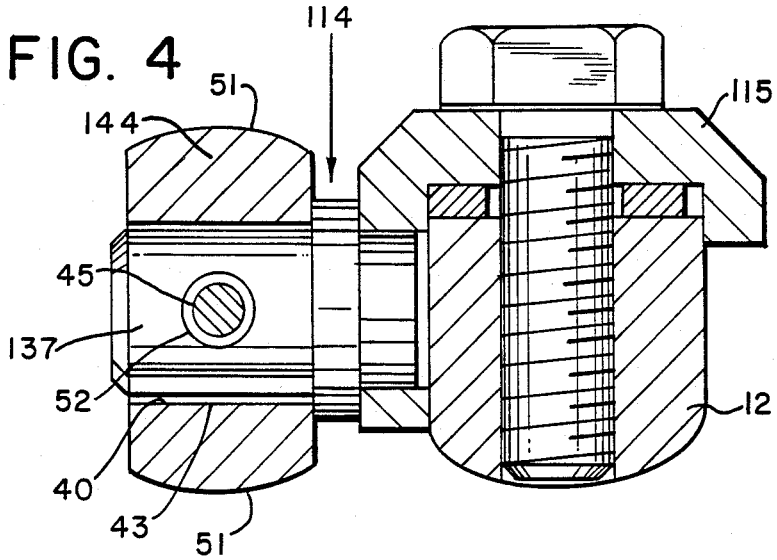
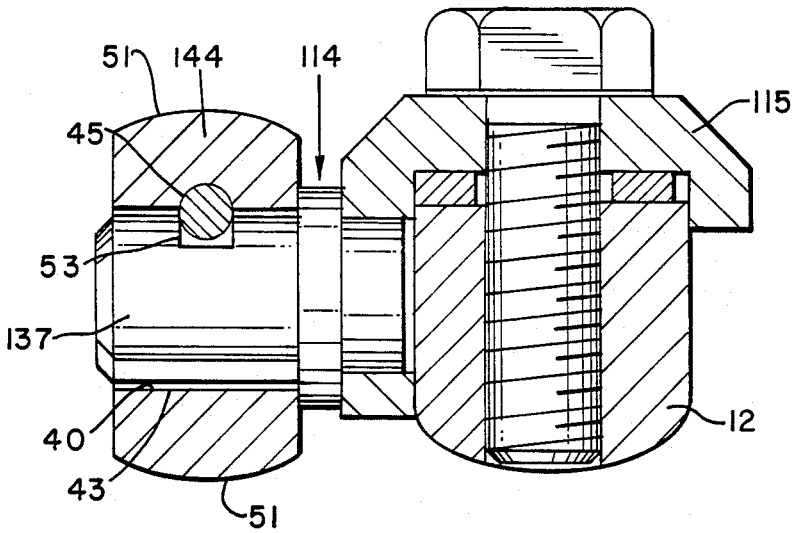
FIG. 4A

FIG. 5
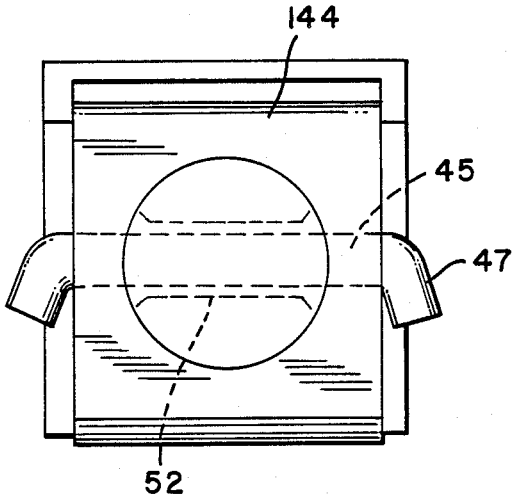
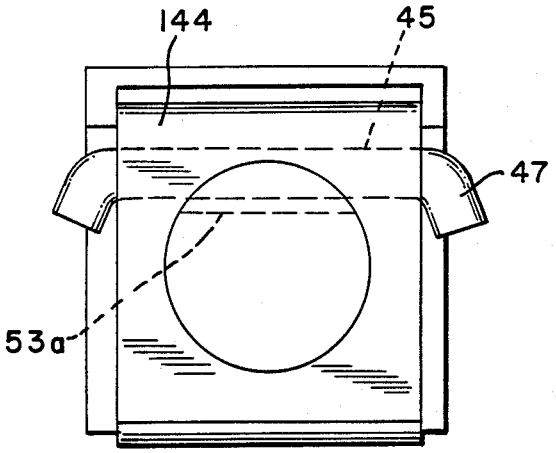
FIG. 5A

FUEL INJECTION PUMP FOR INTERNAL COMBUSTION ENGINES

BACKGROUND OF THE INVENTION

The invention is based on a fuel injection pump.

In slide-controlled fuel injection pumps, the axial position of the control slide usually determines the start of injection or the end of injection. However, there are also such pumps in which the injection quantity is controlled by means of the axial position of the control slide. In any case, an inexact axial position of the control slide has disadvantageous consequences for the quality of injection, which has immediate consequences for the combustion, with the result that the engine runs untrue because of the incorrectly timed injection or runs too quickly or two slowly because of the inexact metering quantity.

In a known fuel injection pump of this type (EP-A 0 181 402), the adjusting bolt engages in the cross groove of the control slide with a spherical head so that there is a punctiform contact between the head and the groove surfaces, which, with the long operating life and high vibration load of these actuating elements, leads to a premature wear and, accordingly, to an undesired play between the head and the groove surfaces with corresponding errors in the fuel control. The installation position of the adjusting bolt is fixed during adjustment, since, because of the eccentric arrangement of the head, the adjustment of the stroke position of the control slide is effected by means of turning the adjusting bolt, with subsequent checking. The play which occurs because of wear, however, works against this adjustment with the results mentioned above.

In another known fuel injection pump of this type (DE-A35 22 414), the adjusting bolt is arranged at a clamping ring so as to be fixed with respect to rotation relative to it; the clamping ring serves as a fastening part and grips the round rotating shaft in a clamp-like manner. The required adjustment can be carried out in a relatively simple manner by means of rotating the clamp on the rotating shaft, but there are also other disadvantages besides the one already mentioned, in that the transmission of force between the adjusting bolt and the respective surfaces of the cross groove is effective in a punctiform manner, since the adjusting bolt is constructed as a rotating part. Accordingly, since the contact is only punctiform, a correspondingly quick and severe wear also occurs in this case on the adjusting bolt as well as on the assigned groove surfaces.

SUMMARY OF THE INVENTION

The fuel injection pump according to the invention achieves substantially less wear because of the line contact between the slide shoe and the cross groove surface, so that no only can a longer service life of these transmission members be achieved, but the quality of the fuel control is also substantially improved.

According to another construction of the invention, the slide shoe is secured against axial displacement on the stud, which can be effected in an advantageous manner by means of a pin which is arranged in the slide shoe so as to be parallel to the contact surfaces of the slide shoe and which engages in an annular groove or cross hole or tangential cross groove arranged in the stud. By means of this, a securing is provided in the axial direction which is not favorable in terms of production, but also causes a minimum of friction between the stud and slide shoe. If the adjusting bolt is connected with the rotating shaft in a known manner (DE-A-35 22 414) by means of a fastening part so as to be fixed against rotation relative to it, and if the pin engages in the cross hole or cross groove at the stud in order to secure the position, the limited rotational play prevents a tilting or jamming of the slide shoe and facilitates the "blind assembly", since the sliding block cannot rotate out of its installation position to an undue extent and can accordingly be easily inserted into the cross groove of the control slide.

Other advantages and advantageous constructions of the invention can be discerned from the following description, the drawing and the claims.

BRIEF DESCRIPTION OF THE DRAWINGS

Two embodiment examples of the subject matter of the invention, with an additional constructional variant, are shown in the drawing and described in more detail in the following.

FIGS. 4 and 5 show views corresponding to FIGS. 2 and 3, but for the second embodiment example, and with a constructional variant for securing the position of the slide shoe shown in FIGS. 4a and 5a.

DESCRIPTION OF THE PREFERRED EMBODIMENTS

Figure 1:
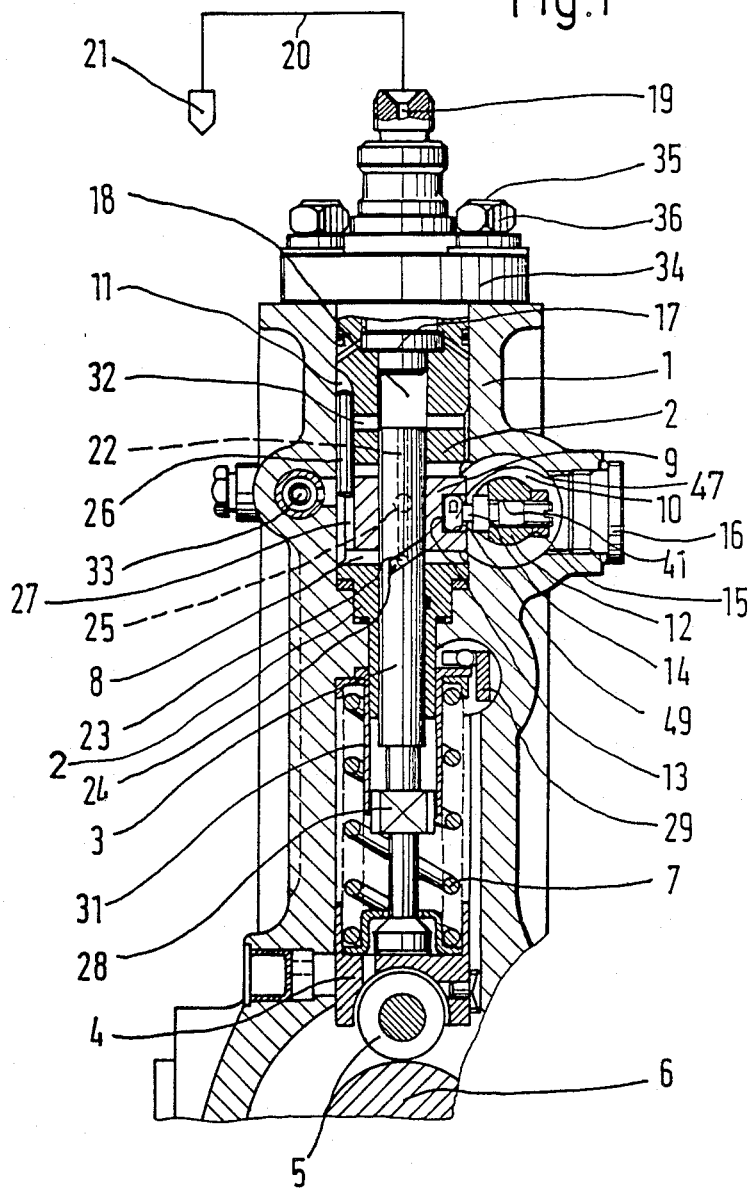
FIG. 1 shows a vertical section through a fuel injection pump, according to the invention.

The fuel injection pump which is shown is a multiple-cylinder pump, of which only on pump element is shown in vertical section according to FIG. 1. Thus, a cylinder liner 2 is admitted in the housing 1, a pump plunger 3 being driven in the cylinder liner 2 against the force of a spring 7 with the intermediary of a roller tappet 4 with roller 5 by means of a camshaft 6 for its axial movement, which forms the working stroke. A recess 8 is provided in the cylinder liner 2, in which recess 8 there is a control slide 9 which is axially displaceable on the pump plunger 3.

The recess 8 of the cylinder liner 2 communicates with a suction space 10 in which a rotating shaft 12 is arranged; the individual control slides 9, only one of which is shown, are axially displaced by means of this rotating shaft 12. There are radially projecting adjusting bolts 14 in the cross holes 41 of the rotating shaft 12 which engage in a cross groove 13 of the control slide 9 and are fixed in their position at the rotating shaft 12 by means of a clamping nut 15 serving as a fastening part. Only one adjusting bolt 14 is shown. A sealing plug 16 is provided in the housing 1 opposite this clamping nut 15, and an adjustment of the individual adjustment bolts 14 is possible after its removal in that the clamping nut 15 is first loosened, then the adjustint bolt 14 is rotated for the purpose of adjustment and then fixed again by means of the clamping nut 15. In this way, the individual control slides 9 of the injection pump can be adapted to one another with respect to their axial positions, since, in the first embodiment example, the adjusting bolts 14 are eccentric bolts, as explained in more detail in the following.

The pump plunger 3 of the cylinder liner 2 and a pressure valve 17, which is inserted in the cylinder liner 2, define a pump work space 18, from which a pressure duct 19 leads to a pressure line 20 which is shown in a simplified manner and which ends at an injection nozzle 21 of the internal combustion engine. There is a pocket borehole 22 in the pump plunger 3, which pocket borehole 22 opens into the pump work space 18, and a cross hole 23 which opens into helical grooves 24 which are incorporated in the outer surface area of the pump plunger 3 on sides which are remote of one another. These helical grooves 24 cooperate with radial boreholes 25 of the control slide 9 in that they are controlled by means of these radial boreholes 25 after a determined stroke of the pump plunger 3 is traveled.

In order that the control slide 9 be secured against rotation during its axial displacement on the pump plunger 3 and in order that an exact assigment of helical grooves 24 and radial boreholes 25 is ensured, a guide pin 26, which engages in an elongated groove 27 of the control slide 9, is inserted in a fitting groove 11 which is provided in the outer surface area of the cylinder liner 2.

At its lower portion, the pump plunger 3 comprises a flattened portion 28 which is acted upon by a carrier member 31, which is rotatable in a known manner by means of a control rod 29, so that an axial displacement of the control rod 29 effects a rotation of the pump plunger 3 and, accordingly, a change of the assigment of the helical grooves 24 to the radial boreholes 25.

A suction borehole 32, which is exposed by the pump plunger 3 in its bottom dead center position (as shown in the drawing), is provided in the cylinder liner 2. The fuel supply of the individual pump elements is effected via a flow-in duct 33. The fuel which does not achieve injection flows out of the recesses 8 into the suction space 10 and, from here, into a return line via a run-off, not shown, and into the fuel tank or a predelivery pump of the injection pump, also not shown.

The cylinder liner 2 comprises a flange 34, with which it is fixed at the housing 1 by means of bolts 35 and nuts 36. The common plane passing through the central axis of the bolts 35 is rotated by approximately 30° relative to the sectional plane through the housing 1 in FIG. 1. The bolts 35 engage in boreholes, no longer shown, which are provided in the pump housing 1 in the area between two pump elements with reference to the longitudinal dimensioning of the pump.

Figure 2:
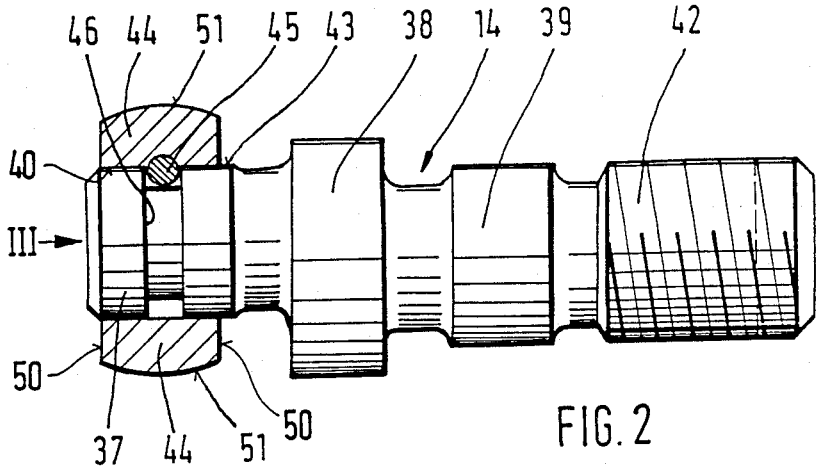
FIG. 2 shows a view of the adjusting bolt in enlarged scale.
Figure 3:
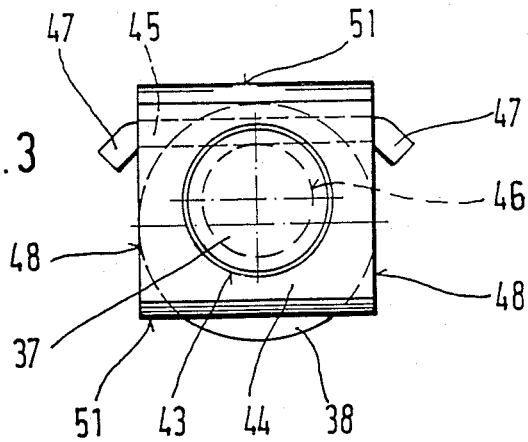
FIG. 3 shows a side view of the adjusting bolt corresponding to arrow III—III in FIG. 2 of the first embodiment example.

The adjusting bolt 14 is shown in FIGS. 2 and 3 in enlarged scale. This adjusting bolt 14 comprises a stud 37 which is arranged eccentrically at a cheek 38, which in turn extends coaxially relative to a bearing portion 39 which is fitted into one of the cross holes 41 of the rotating shaft 12. Moreover, a threaded portion 42 is provided at this asjuting bolt 14, which threaded portion 42 carries the clamping nut 15 so that the cheek 38 is clamped at the rotating shaft 12 in such a way as to prevent a rotation of this adjusting bolt 14 in the rotating shaft 12.

The eccentric stud 37 comprises a cylinder outer surface area 43 on which a slide shoe 44 is inserted by means of a central borehole 40. This slide shoe 44 is secured against axial displacement by means of a pin 45, wherein this pin 45 engages in an annular groove 46 of the stud 37. Accordingly, it is possible for the slide shoe 44 to rotate on the stud 37. The pin 45 is fastened in the slide shoe 44 so as to be parallel to the contact surfaces 51 and tangential with respect to the wall of the central borehole 40 of the slide shoe 44 or with respect to the cylindrical outer surface are 43 of the stud 27.

As can be seen from FIG. 3, the ends 47 of the pin 45 project out over the side surfaces 48 of the slide shoe 44 and are bent in order to prevent the pin 45 from falling out. The surfaces 51 of the slide shoe 44, which cooperate with the working surfaces 49 of the groove 13, are constructed so as to be curved so that there is a cylindrical cross section of the slide shoe 44 with flattened front faces 50 (FIG. 2) and a line contact is ensured between the working surfaces 49 and the surfaces 51, which are also designated as contact surfaces.

The fuel injection pump shown in FIGS. 1 to 3 functions as follows: During at least one portion of the suction stroke of the pump plunger 3, and in the area of the bottom dead center point of its stroke movement, fuel flows into the pump work space 18 from the suction space 10 via the helical grooves 24, the cross hole 23, the pocket borehole 22, and the suction borehole 32. During the subsequent pressure stroke of the pump plunger 3, which is effected by means of the camshaft 6, roller 5 and roller tappet 4, the pressure required for the injection first builds up in the pump work space 18 when these flow-in ducts between the suction space 10 and the pump work space 18 are blocked. Up to this period, fuel flows out of the pump work space 18 again, back into the suction space 10 via these ducts. After these fuel control locations are closed, the high pressure required for the injection builds up in the pump work space 18, and the delivery to the internal combustion engine begins with injection. After the high-pressure stroke of the pump plunger 3 is traveled, the pump work space 18 is connected with the suction space 10 in that the helical grooves 24 overlap the radial boreholes 25 so that the fuel, which is delivered further, is controlled under high pressure. This effective injection stroke of the pump plunger 3 depends on its rotational position, which is determined by means of the control rod 29. According to the rotational position, the distance of the helical grooves 24 from the radial boreholes 25 differs, which corresponds to an injection stroke of differing length, this distance being determined by the rotational position. On the other hand, the axial position of the control slide 9 determines the start of the high-pressure injection with reference to the rotational position of the camshaft 6. The further the control slide 9 is pushed upward, the later these helical grooves 24 are immersed in the control slide 9 and the later these helical grooves 24 are controlled again by means of the radial boreholes 25 for ending the injection; i.e., this is an exactly proportional relationship. Whereas the adjustment of the individual control slides 9 for a corresponding assignment of the start of injection of the individual pump cylinders is effected by means of a change in the position of the adjusting bolts 14, the adjustment of the delivery quantity of the individual cylinders to one another is achieved in that the cylinder liners 2 in the pump housing are rotated so that the relative rotational position of the control slides 9 with respect to the pump plunger 3 is adjustable by means of the guide pin 26, resulting in an adjustment of the injection quantity. When the adjusting bolts 14 are adjusted, the latter are moved into the cross holes 41 of the rotating shaft 12 until the required position is achieved because of the eccentricity between the stud 37 and the bolt axis. During this adjustment, the slide shoe 44 contacts the working surfaces 49 of the cross groove 13 of the control slide 9 linearly with its contact surfaces 51. Because of the ability of the slide shoe 44 to rotate on the stud 37, the fit between the slide shoe 44 and the cross groove 13 is not impaired.

The second embodiment example, which is shown in FIGS. 4 and 5 with a constructional variant shown in FIGS. 4*a* and 5*a*, substantially differs from the previously described first embodiment example in that the securing of the position of the slide shoe is changed and only allows a limited rotation and in that the adjusting bolts are constructed differently and are mounted at the rotating shaft by means of a fastening clip so as to be nonrotatable. Identical parts are provided with the same reference numbers, differing parts are provided with reference numbers which are increased by 100, and new parts are provided with new reference numbers.

The adjusting bolt 114 of the second embodiment example, like the adjusting bolt 14 of the first embodiment example, carriers the cylindrical stud 137 at its end portion which engages in the cross groove 13 of the control slide 9, which stud 137 carries the slide shoe 144. The adjusting bolt 114 is fastened at a fastening part 115, which is constructed as a U-shaped stirrup, and is fixed in its position so as to be nonrotatable, for example, by means of hard soldering. For the purpose of securing the position against axial displacement on the stud 137, a pin 45 is provided which is arranged so as to be parallel to the contact surfaces 51 in the slide shoe 144 and is inserted through a cross hole 52 in the stud 137, which cross hole 52 intersects the longitudinal axis of the stud 137. The position of the pin 45 is fixed by means of bending its free ends 47, as already described with reference to FIG. 3. The diameter of the cross hole 52 is selected so as to be greater than the diameter of the pin 45 such that a limited rotational play of the slide shoe 144 amounting to a few angular degrees, preferably ±5° in either rotational direction, is possible. This limited rotational play serves, first, to compensate the alignment errors and accordingly to prevent a jamming or tilting of the constructional parts which contribute to the control of the stroke slide position; and, secondly, the slide shoe 144 is prevented from being rotated out of its installation position, which is provided for the actuation of the control slide 9, when the rotating shaft 12 is inserted. Accordingly, a so-called "blind assembly" is possible, i.e. the slide shoes 144, which are arranged on the adjusting bolts 114 so as to be secured in their position, which adjusting bolts 114 are previously adjusted in their installation position with respect to the rotating shaft 12, are automatically centered during assembly in the cross grooves 13 of the control slide 9 which receive them; this is effected with the help of their curved contact surfaces 51 and by the fact that they can rotate out of the final installation position by one a few angular degrees.

The previously mentioned adjustment of the installation position of the adjusting bolts 114, which installation position is responsible for the correct stroke position of the control slide 9, is to be carried out outside of the governor housing and is effected by means of exchanging intermediate plates of varying thickness between the two opposite surfaces at the rotating shaft 12 and the fastening part 115, but this is not the subject matter of the present invention.

If, in the case of cramped installation conditions and relatively considerable changes in the position of the control slide with the resulting correspondingly large rotational angles of the rotating shaft 12, it should turn out that the limited axial mobility of the slide shoe 44 resulting from the difference in diameter between the cross hole 52 and the pin 45 has unfavorable consequences for the metering accuracy of the fuel injection pump, then a construction variant, drawn in a dash-dot line, is preferred for securing it in position. In this constructional variant, the pin 45 occupies the same position as in the first embodiment example according to FIGS. 1 to 3. The pin 45 passes through the slide shoe 144 parallel to its contact surfaces 51 and tangentially with respect to the wall of the central borehole 40 in the slide shoe 144. A cross groove 53, which is directed in the same direction, is incorporated in the cylindrical outer surface area 43 of the stud 137 at the adjusting bolt 114, the pin 45 engages in the cross groove 53 at a slight lateral, but somewhat enlarged, distance from the groove base 53*a*. This distance of the pin 45 from the groove base 53*a* is dimensioned in such a way as to ensure the previously described rotational play of the slide shoe 144, which is limited to a few angular degrees. Aside from the advantages and effects already mentioned with reference to the second embodiment example, this securing of the position of the slide shoe 144 allows the greatest possible reduction of axial play, while retaining the rotational play.

All of the characteristic features mentioned in the preceding description, particularly the adjusting bolt 14 and 114 with slide shoes 44 and 144, and those discernible only from the drwing, are, as additional constructions, component parts of the invention even when they are not particularly emphasized or, in particular, not mentioned in the claims.

We claim:

1. A fuel injection pump for internal combustion engines, comprising:

a pump housing with a borehole;

at least one pump element having a pump cylinder fixed in said borehole of said pump housing and having a pump plunger reciprocably driveable in said pump cylinder, said pump cylinder being formed as a cylinder liner, said pump plunger being rotatable for fuel control;

a control slide (9) axially displaceable on said pump plunger (3) and having a cross groove (13) with contact surfaces (49); and axially displacing means for axially displacing said control slide (9) including a rotatable shaft (12) supported in said pump housing, at least one radially projecting adjusting bolt (14) releasably fastened at said rotatable shaft (12), and a slide shoe (44; 144) with a central borehole (40), said adjusting bolt (14) having an end portion engaging in said cross groove (13) of said control slide (9), said end portion being formed as a cylindrical stud (37; 137) with an axis, said cylindrical stud (37; 137) being rotatably connected to said slide shoe (44; 144) in said central borehole (40), said slide shoe (44; 144) having a rectangular shape extending perpendicular to an axis of said central borehole (40) so that linear contact prevails between said slide shoe (44; 144) and said cross groove (13), said slide shoe (44; 144) having a cylindrical cross-section with two flattened front faces (50) in a plane lying in said axis of said stud (37; 137) and perpendicular to an axis of said rotatable shaft (12) so as to have curved contact surfaces (51) between said front faces (50) and opposite said contact surfaces (49) of said cross groove (13).

2. Fuel injection pump according to claim 9, characterized in that the slide shoe (44; 144) is secured against axial displacement of the stud (37; 137).

3. Fuel injection pump according to claim 2, wherein said adjusting bolt is constructed as an eccentric bolt, said central borehole (40) being defined by a wall, said stud (37) having an annular groove (46), further comprising securing means and including a pin (45) arranged in said slide shoe (44) so as to be parallel to said contact surface (51) of said slide shoe (44) and so as to be tangential to said wall of said central borehole (40), said pin (45) engaging in said annular groove (46) of said stud (37).

4. Fuel injection pump according to claim 3, characterized in that the pin (45) is bent so as to project outward over lateral surfaces (48) of the slide shoe (44; 144), and is fastened so as to prevent the pin (45) from falling out.

5. Fuel injection as defined in claim 2, further comprising means for fastening said adjusting bolt with said rotatable shaft and including a fastening part rotatably fixing said adjusting bolt to said rotatable shaft so as to be rotatable in two rotational directions therewith.

6. Fuel injection pump according to claim 5, wherein said stud (137) has a cross hole (52); and further comprising means for securing against axial displacement and including a pin (45) arranged in said slide shoe (144) so as to be parallel to said contact surfaces (51) of said slide shoe (144) and being inserted through said cross hole (52) in said stud (137) of said adjusting bolt (114), said pin (45) having a diameter, said cross hole (52) being formed with a diameter greater than said diameter of said pin (45) so as to ensure that said slide shoe (144) has a rotational play limited to at most five angular degrees in one of said two rotational directions.

7. Fuel injection pump according to claim 6, characterized in that the pin (45) is bent so as to project outward over lateral surfaces (48) of the slide shoe (44; 144) and is fastened so as to prevent the pin (45) from falling out.

8. Fuel injection pump according to claim 5, wherein said central borehole (40) is defined by a wall, said stud (137) having a cylindrical outer surface area (43) with a cross groove (53); and further comprising means for securing against axial displacement and including a pin (45) arranged in said slide shoe (144) so as to be parallel to said contact surfaces (51) of said slide shoe (144) and tangential to said wall of said central borehole (40), said pin (45) engaging in said cross groove (53) at said adjusting bolt (114), said cross groove (53) having a groove base (53a) arranged at a distance from said pin (45) such that said slide shoe (144) has a rotational play limited to at most five angular degrees in one of said two rotational directions.

9. Fuel injection pump according to claim 8, characterized in that the pin (45) is bent so as to project outward over lateral surfaces (48) of the slide shoe (44; 144), and is fastened so as to prevent the pin (45) from falling out.

* * * * *